US006345885B1

(12) United States Patent
Lin et al.

(10) Patent No.: US 6,345,885 B1
(45) Date of Patent: Feb. 12, 2002

(54) INK-JET PRINTHEAD AND MANUFACTURING PROCESS

(75) Inventors: Chen-hua Lin; Shih-hung Lee; Ji-chen Wu, all of Hsinchu (TW)

(73) Assignee: Wisertek International Corporation (TW)

( * ) Notice: Subject to any disclaimer, the term of this patent is extended or adjusted under 35 U.S.C. 154(b) by 0 days.

(21) Appl. No.: 09/559,433

(22) Filed: Apr. 27, 2000

(30) Foreign Application Priority Data

Dec. 10, 1999 (TW) ..... 88121835 A

(51) Int. Cl.[7] ..... B41J 2/05
(52) U.S. Cl. ..... 347/61
(58) Field of Search ..... 347/64, 65, 63, 347/56

(56) References Cited

U.S. PATENT DOCUMENTS 4,809,428 A * 3/1989 Aden et al. ..... 29/611
5,502,471 A * 3/1996 Obermeier et al. ..... 347/65

* cited by examiner

*Primary Examiner*—John Barlow
*Assistant Examiner*—Robert D. Loper

(57) ABSTRACT

An ink-jet printhead and its manufacturing process therefor. The manufacturing process comprises the steps of: providing a substrate; forming a loop-shaped protection layer of a predetermined size over the central region of the substrate, the loop-shaped protection layer defining a predetermined area surrounded thereby; and forming an ink passage by sand blasting through the substrate on the predetermined area so that the ink within the ink cartridge can flow into the ink-jet printhead through the ink passage.

Therefore, during the sand blasting process, cracking of the IC chip can be avoided because of the protection by the loop-shaped protection layer.

11 Claims, 2 Drawing Sheets

INK-JET PRINTHEAD AND MANUFACTURING PROCESS

FIELD OF THE INVENTION

The present invention relates to an ink-jet printhead and a manufacturing process therefor, and more particularly to an ink-jet printhead, wherein the ink is supplied via an ink passage located in the central portion of the printhead, and a manufacturing process therefor, wherein the IC chip of the printhead can be prevented from cracking and a crack in the chip can be prevented from propagating when forming the ink passage by sand blasting so that the yield of the manufacturing process can be raised.

BACKGROUND OF THE INVENTION

Ink-jet printers have been popular in recent years because of their fine printing quality, portable sizes, and fast printing speed with low noises.

In the present state of the art, an ink-jet printer typically comprises a thermal bubble type printhead or a piezoelectric type printhead. In a thermal bubble type printhead, a heating element is heated to reach a high temperature and cause a bubble generated in the ink instantly so that the pressure of the bubble ejects a small amount of ink. A piezoelectric type printhead uses a piezoelectric element that is responsive to the voltage applied on it and exerts a pressure on the ink through a thin film to eject the ink.

A conventional thermal bubble type printhead is provided with a plurality of ink ejection devices. Each of the ink ejection devices includes a heating element, an ink chamber, an ink ejection orifice, and a control unit. The control unit takes control of the heating function of the heating element so that a bubble of a predetermined size can be generated in the ink within the ink chamber when the ink is heated and a small amount of ink can be ejected from the ink ejection orifice for ink-jet printing.

For the thermal bubble type printhead, the heating elements and the conductive traces for connecting the control units are formed in or on a substrate so that control signals from the control units can be transmitted to the heating elements via the conductive traces for controlling ink-jet printing. Moreover, an ink chamber relative to each of the heating elements is formed in the substrate so that the ink within the ink cartridge can flow in the ink chamber of the printhead. An ink passage is formed in the central portion of the substrate by sand blasting. However, around the ink passage, there can be a crack or crack propagation incurred by sand blasting. This decreases the yield of the manufacturing process or affects the normal ink supply.

SUMMARY OF THE INVENTION

An object of the present invention is to provide an ink-jet printhead and a manufacturing process therefor so that when forming an ink passage in a substrate by sand blasting, the substrate can be prevented from cracking or a crack in the substrate can be prevented from propagating and thereby the yield of the manufacturing process can be raised.

Another object of the present invention is to provide an ink-jet printhead and a manufacturing process therefor so that the ink supply of the ink-jet printhead can be smoother over the prior art ink-jet printhead.

In accordance with the present invention, an ink-jet printhead and its manufacturing process are disclosed, wherein a substrate is provided and a loop-shaped protection layer of an appropriate size is formed on the central part of the substrate. The area surrounded by the loop-shaped protection layer is defined as an area for forming an ink passage through the substrate. An ink passage is formed on the predetermined area by sand blasting.

Just because of the loop-shaped protection layer formed beforehand, sand blasting on the area surrounded by the protection layer would not damage the substrate itself, and no cracking will be incurred. This results in high production yield, and moreover, this protection layer can be formed at the same time when forming the resistance layer, from which heating elements can be formed or the conduction layer by the photolithography, so the overall number of steps is kept the same.

DETAILED DESCRIPTION OF THE PREFERRED EMBODIMENT

Figure 1:
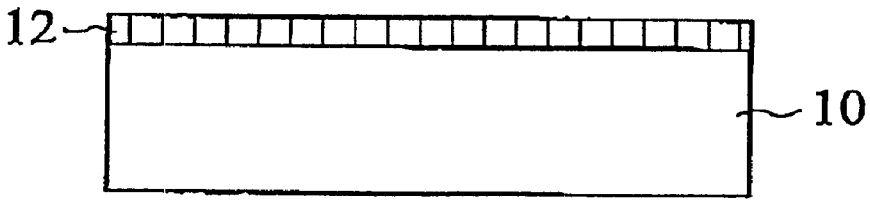
FIG. 1 is a schematic drawing illustrating the first step of the process for manufacturing an ink-jet printhead in accordance with a preferred embodiment of the invention.

Referring to FIG. 1, an ink-jet printhead manufactured by the process of the invention includes a substrate 10, for example a silicon substrate, on which a dielectric layer 12 (an $SiO_2$ layer for example) is formed by thermal oxidation.

Figure 2:
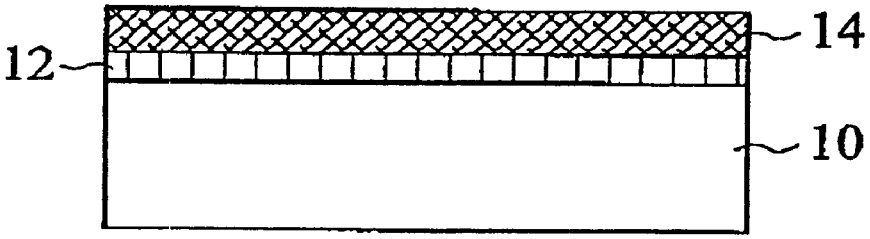
FIG. 2 is a schematic drawing illustrating the second step of the process for manufacturing an ink-jet printhead in accordance with a preferred embodiment of the invention.
Figure 3:
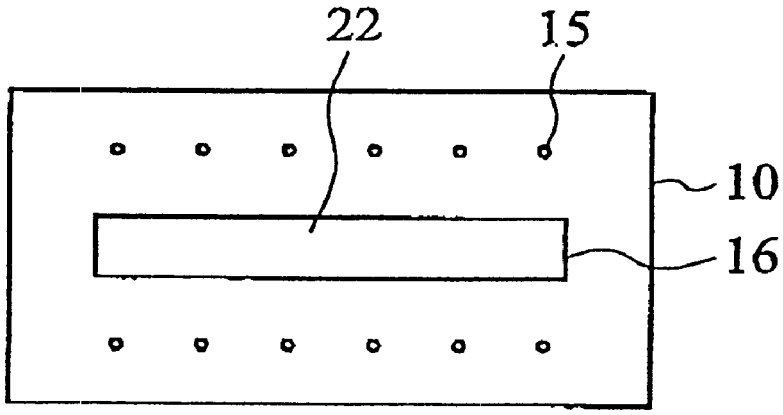
FIG. 3 is a top view showing the substrate of an ink-jet printhead in accordance with a preferred embodiment of the invention.

Referring to FIGS. 2 and 3, on top of the dielectric layer 12 is formed a TaAl layer as a resistance layer 14 by sputtering deposition. The thickness of the resistance layer 14 is preferably 3000–8000 Å. A plurality of heating elements 15 of the ink-jet printhead is formed by photo-etching (photolithography). As the resistance layer 14 is formed, a first loop-shaped protection layer 16 of a suitable size is also formed on the central region of the substrate 10. The region surrounded by the loop-shaped protection layer 16, which is also made of TaAl, is preserved for an ink passage 22 as shown in FIG. 3.

Figure 4:
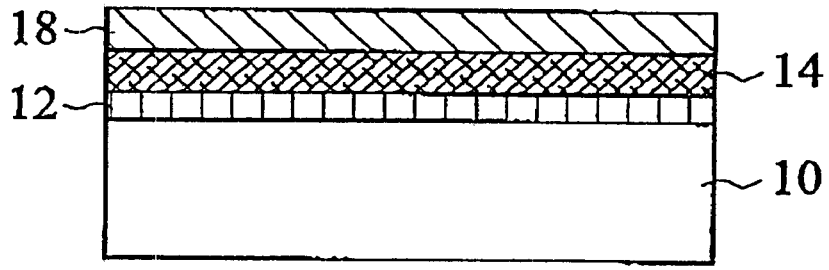
FIG. 4 is a schematic drawing illustrating the third step of the process for manufacturing an ink-jet printhead in accordance with a preferred embodiment of the invention.

Referring to FIG. 4, on the resistance TaAl layer 14 is formed an aluminum layer as a conduction layer 18 of the ink-jet printhead by sputtering deposition. The thickness of the conduction layer 18 is 3000–8000 Å, in the meantime a second loop-shaped protection layer (not shown) is also formed in a position relative to the first loop-shaped protection layer 16.

Figure 5:
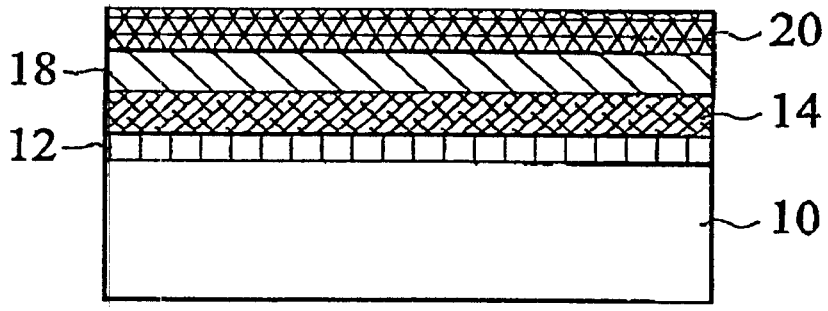
FIG. 5 is a schematic drawing illustrating the fourth step of the process for manufacturing an ink-jet printhead in accordance with a preferred embodiment of the invention.

Referring to FIG. 5, on the conduction layer 18 is formed a photoresist layer 20 as a mask in etching the preserved region surrounded by the first and the second loop-shaped protection layers 16 for the ink passage 22.

Figure 6:
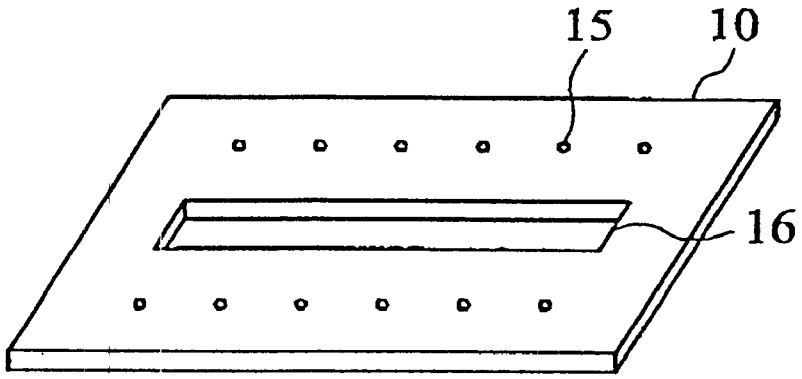
FIG. 6 is the pictorial view showing the substrate of an ink-jet printhead in accordance with a preferred embodiment of the invention.

Referring to FIG. 6, the ink passage 22 is formed by sand blasting on the substrate 10; this process will not damage the region around the ink passage 22 at all due to the protection of the first and second protection layers 16.

By the above implementation, the ink within the ink cartridge can flow onto the heating elements 15 through the ink passage 22 during ink-jet printing.

Another embodiment is to form a loop-shaped protection layer on the substrate 10 while both the second loop-shaped protection layer and conduction layer 18 are formed over the heating elements 15; then as a mask a photoresist layer 20 thereon is formed to etch the region surrounded by the second loop-shaped protection layer for the ink passage 22, which is formed by sand blasting.

Therefore, according to the manufacturing process of the present invention, a previously prepared loop-shaped protection layer around the ink passage 22 can protect the IC chip from damage during sand blasting, this results in a high production yield and smooth ink supply.

In particular, the first and second loop-shaped protection layers are formed simultaneously with the process of forming the resistance layer 14 and conduction layer 18 or only the second loop-shaped protection layer (no shown) is formed during the process of forming the conduction layer 18. Therefore, compared with the prior art, the number of steps of the invention will not be increased While the invention has been described by way of example and in terms of two preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An ink-jet printhead, comprising:

a substrate;

at least one heating element provided on said substrate;

an ink passage formed in a central portion of said substrate;

a first loop-shaped protection layer formed on said substrate, open in the central portion of said substrate, and surrunding said ink passage; and an orfice element provided on said substrate and having at least one ejection orfice formed corresponding to said at least one heating element wherein said first protection layer is formed simultaneously with said at least one heating element.

2. An ink-jet printhead according to claim 1, wherein said substrate is a silicon substrate.

3. An ink-jet printhead according to claim 1, further comprising a resistance layer is formed on said substrate; and conduction layer formed on said resistance layer and having at least one conductive trace connected to said at least one heating element;

wherein said at least one heating element and said at least one conductive trace are formed by photolithography.

4. The inkjet printhead according to claim 3, further comprising a second protection layer formed simultaneously with said conduction layer and open in the central portion of said substrate.

5. A manufacturing process for an ink-jet printhead to be mounted on an ink cartridge and eject ink out of the ink cartridge, the manufacturing process comprising the steps of:

providing a substrate;

forming a first loop-shaped protection layer on said substrate and open in a central region of said substrate;

forming a resistance layer on said substrate simultaneously with said first protection layer; and forming an ink passage by sand blasting through said substrate in the central region thereof so that the ink in the ink cartridge can flow into the inkjet printhead through the ink passage.

6. The manufacturing process according to claim 5, wherein said substrate is a silicon substrate.

7. The manufacturing process according to claim 5, wherein said resistance layer is a TaAl layer formed by sputtering deposition.

8. The manufacturing process according to claim 5, wherein a dielectric layer is formed on said substrate before forming said resistance layer on said substrate.

9. The manufacturing process according to claim 8, wherein said dielectric layer is an $SiO_2$ layer formed by thermal oxidation.

10. The manufacturing process according to claim 5, further comprising, after said forming of said resistance layer, forming a conduction layer on said resistance layer.

11. The manufacturing process according to claim 10, further comprising forming a second protection layer simultaneously with said conduction layer, said second protection layer being open in the central region of said substrate.

* * * * *